US006286928B1

(12) United States Patent
Kasamatsu

(10) Patent No.: US 6,286,928 B1
(45) Date of Patent: Sep. 11, 2001

(54) APPARATUS FOR PURGING AN INK JET HEAD, AND INK JET RECORDER INCLUDING SAME

(75) Inventor: Daisuke Kasamatsu, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/105,037

(22) Filed: Jun. 26, 1998

(30) Foreign Application Priority Data

Jun. 30, 1997 (JP) ..... 9-173334

(51) Int. Cl.[7] ..... B41J 2/165; B41J 29/38
(52) U.S. Cl. ..... 347/23; 347/17; 347/29
(58) Field of Search ..... 347/23, 17, 29, 347/35; 358/96, 502; 399/44.94

(56) References Cited

U.S. PATENT DOCUMENTS 5,781,024 * 7/1998 Kanematsu et al. ..... 347/17
5,949,447 * 9/1999 Arai et al. ..... 347/23

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

An ink jet recorder includes an ink jet head having nozzles, through which ink can be ejected. The recorder also includes an apparatus for purging the head. The apparatus includes a cap for covering the nozzles. The apparatus also includes a suction pump for sucking ink from the head through the cap covering the nozzles. The apparatus further includes a memory, a temperature sensor and a controller. The memory stores the purge interval at which the pump should suck ink. The sensor measures ambient temperature. If the measured temperature is abnormal, the controller replaces the stored purge interval with shorter interval. In this case, the apparatus purges the head at the shorter interval. This keeps the ejection of ink in good condition regardless of ambient temperature.

23 Claims, 5 Drawing Sheets

APPARATUS FOR PURGING AN INK JET HEAD, AND INK JET RECORDER INCLUDING SAME

BACKGROUND OF THE INVENTION

1. Field of the Invention

The present invention relates to an apparatus for purging the ink jet head and an ink jet recorder including the ink jet head. In particular, the invention relates to an ink jet head purging apparatus which can suitably change the suction time interval depending on ambient temperature variations, and an ink jet recorder including the ink jet head.

2. Description of Related Art

A conventional ink jet printer includes a print head having a number of nozzles for ejecting ink to print a sheet of paper. While the head is used, air bubbles may be produced in it, and ink may stick to the nozzle walls, resulting in defective ejection of ink. If the printer is not used for a long time, the nozzles may clog with thick ink, resulting in defective ejection of ink. Defective ejection of ink results in defective print. In this case, the nozzles are purged to recover good ejection of ink. The purging includes capping the head with a suction cap, and sucking ink out of the capped head by a pump developing negative pressure. Normally, the nozzles are purged at regular interval of time, which may be five days.

Because the ink ejected from the print head is a viscous liquid, however, its state may change at abnormal temperature. Therefore, at abnormal temperature, if the nozzles are not purged frequently, the ejection of ink from nozzles may become defective. If the purging time interval is short on the assumption that the temperature may be abnormal, the purges at normal temperature are too frequent. This accelerates the ink consumption of the printer, because the purging involves suction of ink.

SUMMARY OF THE INVENTION

In view of the foregoing problem, it is an object of the invention to provide an ink jet head purging apparatus which can change the suction time interval depending on ambient temperature variations. It is another object to provide an ink jet recorder including such a purging apparatus.

In accordance with a first aspect of the invention, an apparatus is provided for purging an ink jet head having nozzles, through which ink can be ejected. The apparatus includes a cap for covering the nozzles. The apparatus also includes a suction pump for sucking ink from the nozzles through the cap covering the nozzles. A memory stores the regular interval at which the pump should suck ink from the nozzles. A temperature sensor measures ambient temperature. Depending on the measured temperature, a suction interval change device can change the stored interval. A controller can operate the pump at the stored interval.

If the ambient temperature measured by the temperature sensor reaches either a low or a high temperature which may cause defective ejection of ink, the suction interval change device changes the suction or purge interval stored in the memory. The changed interval may be shorter than the set interval. The controller causes the suction pump to suck ink at the changed interval. Therefore, the apparatus can purge the ink jet head at suitable interval depending on the temperature history around the head. Consequently, the ejection of ink from the head can be kept in good condition at any temperature.

The purging apparatus may include a counter counting how many times the temperature measured by the temperature sensor is out of a predetermined range of temperature, which may be between 10 and 35 centigrade. If the temperature has been out of the range more than a predetermined number of times, which may be 24 times, the controller may cause the suction pump to suck ink. The reason for this is that it is enough to purge the ink jet head only if the ambient temperature keeps abnormal for a predetermined period. This prevents the head from being purged too often and ink from being wasted.

The purging apparatus may include a timer for clocking the elapsed time after the preceding purge.

The purging apparatus may include a reset device for initializing the stored purge interval after the suction pump sucks ink. For instance, if the suction interval change device has shortened the stored interval from five days to three days, the reset device replaces the shortened interval with five days again. Consequently, after the ink jet head is purged, it is purged at the same interval to keep its ejection of ink in good condition unless the ambient temperature becomes abnormal. After the pump sucks ink, the reset device may reset at least one of the counter and the timer.

The temperature sensor may be a temperature detecting circuit including a thermister.

The controller may be an exclusive purge controller fitted in the purging apparatus. Otherwise, the controller may be a minicomputer connected to the apparatus. The controller may also function as the suction interval change device.

In accordance with a second aspect of the invention, an ink jet recorder is provided. The recorder includes an ink jet head having nozzles, through which ink can be ejected. The recorder also includes an apparatus for purging the head. The apparatus includes a cap for covering the nozzles. The apparatus also includes a suction pump for sucking ink from the nozzles through the cap covering the nozzles. A memory stores the regular interval at which the pump should suck ink from the nozzles. A temperature sensor measures ambient temperature. Depending on the measured temperature, a suction interval change device can change the stored interval. A controller can operate the pump at the stored interval.

Depending on ambient temperature, the purge interval of the purging apparatus (recovery mechanism) of the recorder are controlled. Therefore, regardless of ambient temperature variation, the ejection of ink from the ink jet head can be kept in good condition.

The purging apparatus of the recorder may purge the ink jet head provided that a signal for recording is input to the recorder. Otherwise, whether a signal for recording is input to the recorder or not, the apparatus may be forced to purge the head at the interval stored in the memory.

The recorder may include a timer for clocking the elapsed time after the preceding suction. When a signal for recording is input to the recorder, the controller compares the elapsed time clocked by the timer with the stored interval. As a result of the comparison, if the clocked time is longer than the stored interval, the controller causes the suction pump to suck ink.

The temperature sensor of the recorder may be a temperature detecting circuit including a thermister.

The controller of the recorder may be an exclusive purge controller fitted in the purging apparatus of the recorder. Otherwise, the controller may be a printer control circuit in the recorder, which may be an ink jet printer. Otherwise, the controller may be a minicomputer connected to the apparatus or the recorder. The controller may also function as the suction interval change device.

BRIEF DESCRIPTION OF THE DRAWINGS

A preferred embodiment of the invention will be described with reference to the accompanying drawings, in which.

DETAILED DESCRIPTION OF PREFERRED EMBODIMENTS

Figure 1:
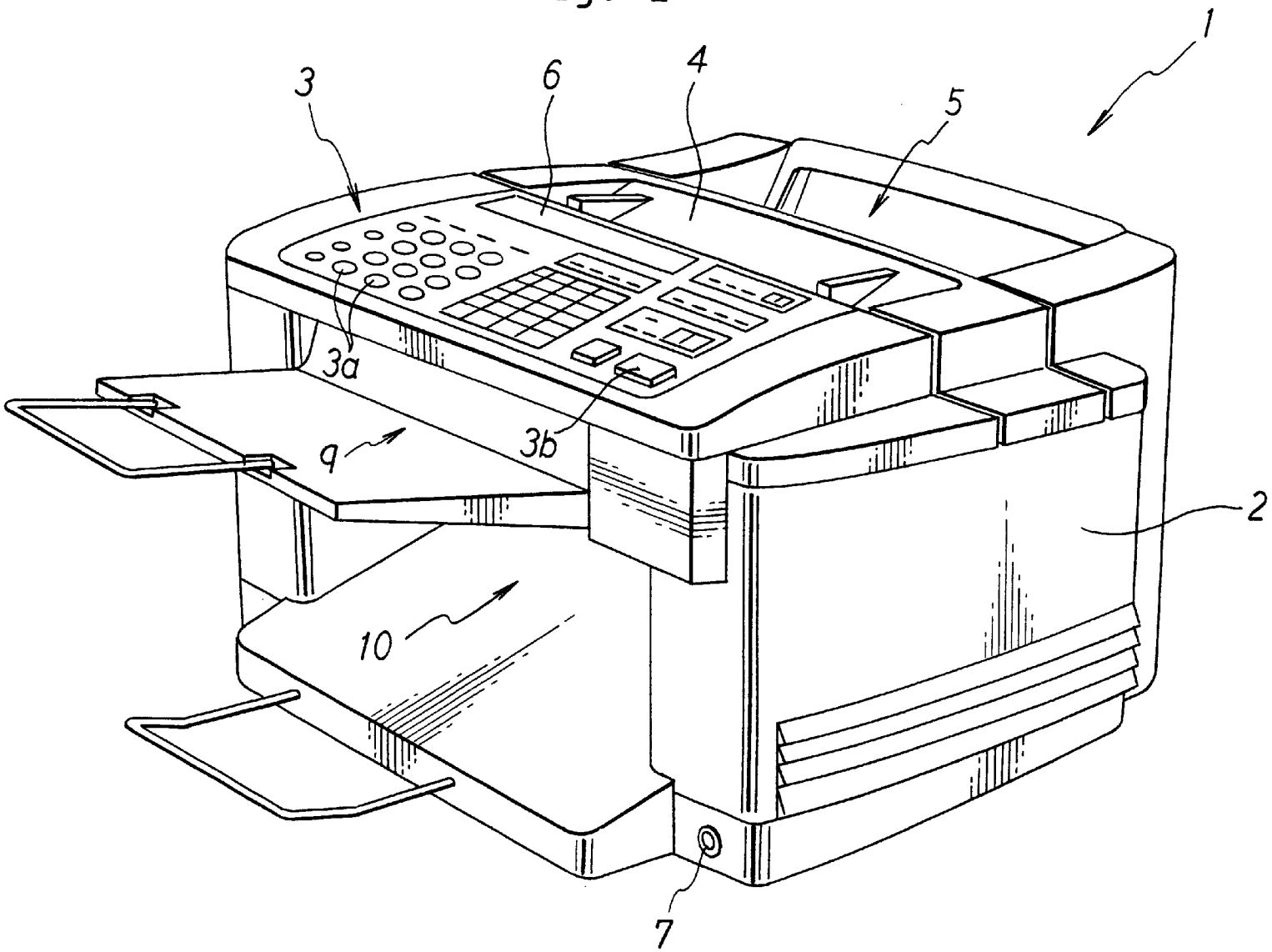
FIG. 1 is a perspective view of a piece of multifunctional peripheral equipment embodying the invention.
Figure 2:
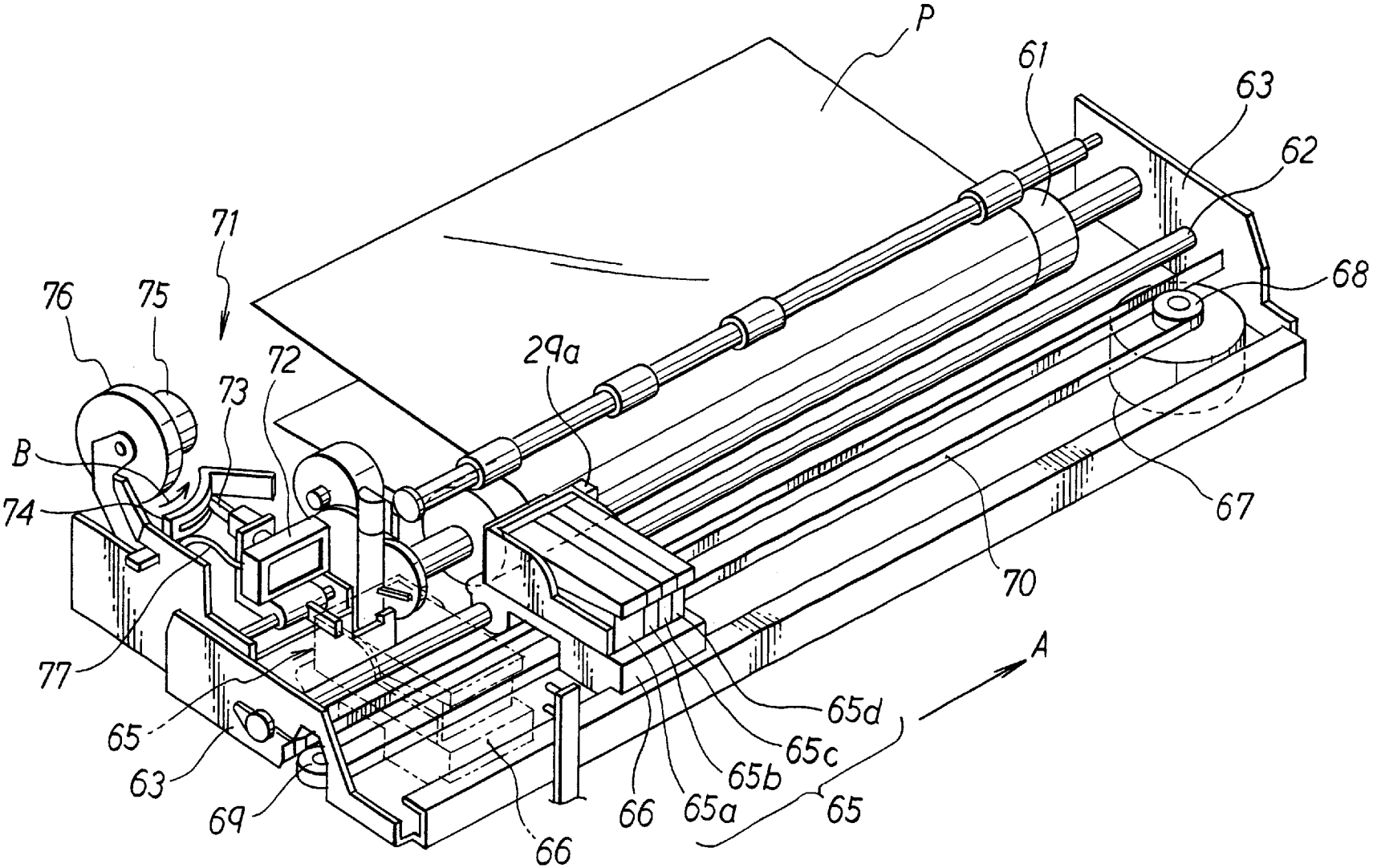
FIG. 2 is a perspective view of the ink jet printer mounted in this equipment.

With reference to FIGS. 1 and 2, a piece of multifunctional peripheral equipment 1 embodying the invention functions as a fax machine, a scanner, a copier, a video printer and another printer. The equipment 1 is fitted with an ink jet printer 26 for multicolored print. The printer 26 is a serial printer, which includes a print head unit 65. The unit 65 is mounted on a carriage 66, which can move in the direction A and the opposite direction.

As shown in FIG. 1, the equipment 1 includes a body 2 in the form of a box. A control panel 3 is mounted on the top of a front portion of the body 2. The panel 3 has numeric buttons 3*a*, a start button 3*b* and other buttons or keys, which can be pushed for various operations. By manipulating some of the buttons, it is possible to set the present time as stated later. The panel 3 has a liquid crystal display 6 formed near its rear, which shows the setting of the equipment 1, an operation message or the like, as the occasion demands. While the equipment 1 is standing by, the display 6 shows the present time.

The equipment 1 also includes an original inlet 4 formed in the rear of the display 6 and an original outlet 9 formed under or below the control panel 3. Fax or copying originals can be stacked in the inlet 4, from which they can be fed into the equipment body 2. The originals can be scanned in the equipment 1, and then be discharged into the outlet 9, where they can be stacked.

The equipment 1 further includes a cassette holder 5 formed in the rear of the original inlet 4 and a sheet outlet 10 formed under the original outlet 9. The holder 5 can hold a sheet cassette (not shown), in which recording sheets are stacked. A recording sheet P can be fed from the cassette, and then be printed by the printer 26. The printed sheet P can be discharged through the outlet 10.

Adjacently on the left (right in FIG. 1) of and below the sheet outlet 10, a video signal input terminal 7 is provided, which can be connected with a video camera. The image data output in the form of video signals from the camera can be sent into the equipment 1, and then be printed by the printer 26.

The printer 26 includes a frame 63, by which a horizontal platen roller 61 is supported rotatably to feed a recording sheet P perpendicularly to it. The roller 61 is parallel with a guide rod 62, which is fixed to the frame 63. The carriage 66 is supported slidably on the rod 62, and can be moved along it by a timing belt 70, which extends between a driving pulley 68 and a driven pulley 69. The driving pulley 68 can be rotated by a carriage motor 67, which is supported by the frame 63 near the left (right in FIG. 2) end of the frame.

The print head unit 65 includes four print heads, and holds ink tanks 65*a*, 65*b*, 65*c* and 65*d*. The tanks 65*a*–65*d* are filled with black, cyan, magenta and yellow inks, respectively, and each connected to one of the heads. Each of the heads has a number of nozzles, through which ink can be ejected. The tanks 65*a*–65*d* can be fitted to and removed from the unit 65 individually. When one or some of the tanks 65*a*–65*d* are short of ink, only it or they can be replaced.

Figure 3:
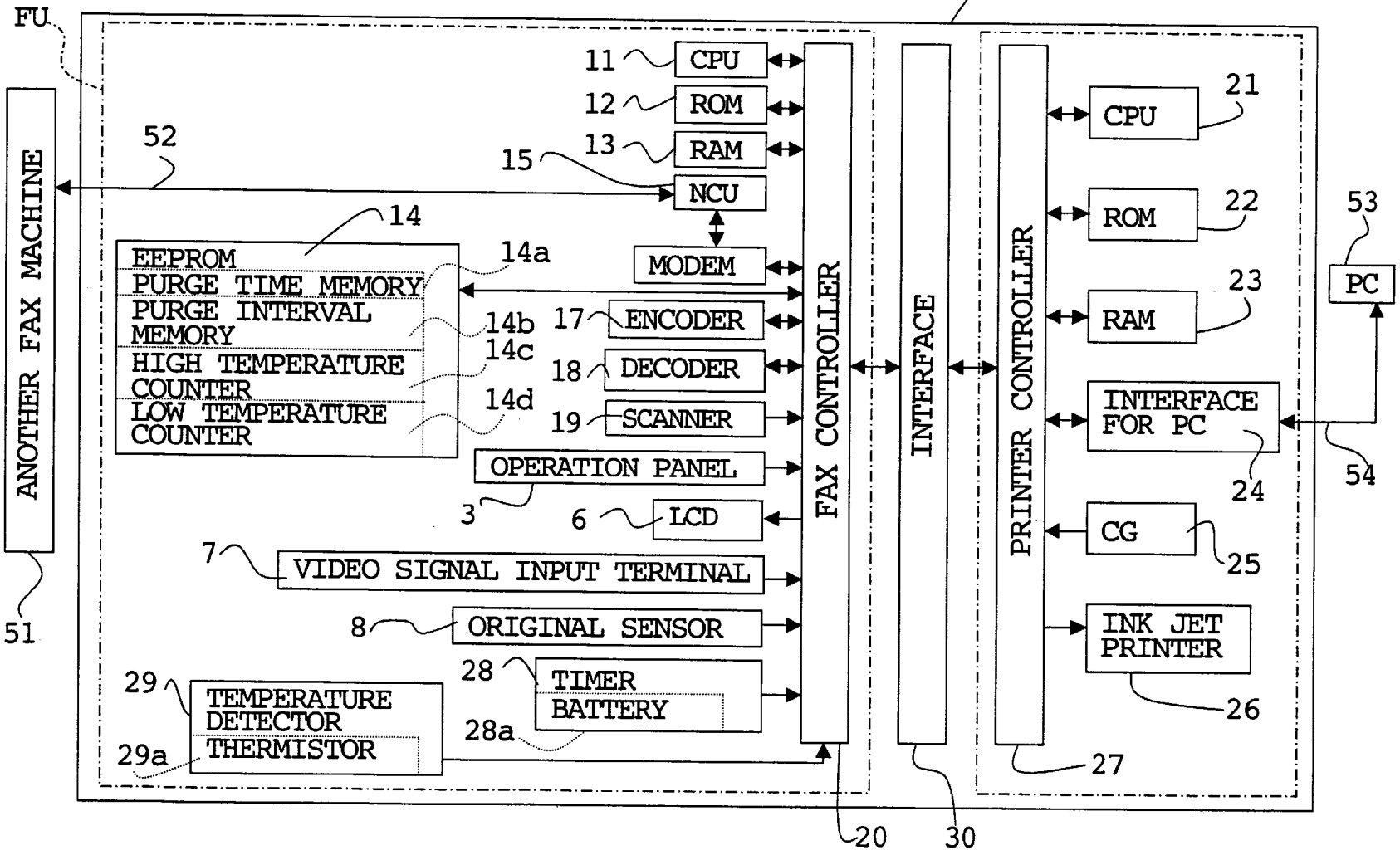
FIG. 3 is a block diagram of the electric system of this equipment.

The print head unit 65 is fitted with a thermister 29*a* near the print heads. The thermister 29*a* is part of a temperature detecting circuit 29 (FIG. 3). The thermister 29*a* converts the temperature around the print heads into a value of electric resistance, and outputs the value to the circuit 29. Near the right (left in FIG. 2) end of the frame 63, a recovery mechanism (an apparatus for purging the print heads) 71 is mounted on the frame 63 to recover normal ejection of ink.

The mechanism 71 includes a suction cap 72, which can cap all the print heads at a time to close all their nozzles. Fixed to the back of the cap 72 is one end of a bar 73 for moving the cap 72 toward and away from the print head unit 65. A lever 74 includes a cylindrical or circular portion in slidable contact with the other end of the bar 73. When the lever 74 moves in the direction B from its position shown in FIG. 2, the cap 72 moves forward with the bar 73. After the carriage 66 moves to its position shown with two-dot chain lines in FIG. 2, the movement of the lever 74 in the direction B causes the cap 72 to cap the heads of the unit 65. The lever 74 can be moved in the direction B and the opposite direction by a cam 76, which can be turned by a motor 75.

The recovery mechanism 71 includes a suction pump (not shown) for suction through a suction tube 77, which is connected to the suction cap 72. The pump can be driven by the cam 76. With the cap 72 capping the print heads, the pump operation sucks ink out of the nozzles of the heads to recover normal ejection of ink. Herein, a series of suction (recovery) actions for recovery of ink ejection is referred to as purging or purges.

With reference to FIG. 3, the equipment 1 includes a facsimile unit FU and a printer unit PU, which are interconnected through an interface 30.

The fax unit FU includes a CPU 11, a ROM 12, a RAM 13, an EEPROM 14, a network control unit (NCU) 15, a modem 16, an encoder 17, a decoder 18, a scanner 19, the control panel 3, the LCD 6, the video signal input terminal 7, an original sensor 8, a timing circuit 28 and the temperature detecting circuit 29. These components are interconnected through a facsimile control circuit 20.

On the basis of signals transmitted and received through the NCU 15, the CPU 11 controls the components connected to the fax controller 20, and implements fax operation etc.

The ROM 12 stores the control programs to be executed by the equipment 1. The stored programs cannot be altered. The RAM 13 can store data, which can be altered.

The EEPROM 14 is a nonvolatile memory. The data stored in this memory can be altered, and is retained even after the power switch of the equipment 1 is turned off. The EEPROM 14 includes a purge time memory 14*a*, a purge interval memory 14*b*, a high temperature counter 14*c* and a low temperature counter 14*d*.

The purge time memory 14*a* stores the time (including the date) at which the preceding purge was carried out. Just after the nozzles are purged, the present time clocked by the timer 28 is written in the memory 14*a*.

The purge interval memory 14*b* stores the regular interval at which the nozzles should be purged. For normal temperature between 10 and 35 centigrade around the print head unit 65, this memory 14*b* stores an initial value of five days as the purge interval. For abnormal temperature below 10 centigrade or above 35 centigrade around the print heads, the memory 14*b* stores a value of three days as the interval. Just after the nozzles are purged, the memory 14*b* is reset for the initial value of five days. Thereafter, if the temperature around the heads is and keeps abnormal, the content of the memory 14*b* is changed to three days. Once this content is changed to three days, it is not reset for the initial value of five days, even if the temperature returns to normal, until the nozzles are purged next.

The purge interval and the abnormal temperatures might be determined suitably depending on ink type etc., and might not be limited to the foregoing values and ranges.

The high temperature counter 14*c* stores the frequency of detection of abnormal temperature above 35 centigrade. The temperature detector 29 detects the temperature around the print heads, every time a process for changing the purge interval (FIG. 4) is carried out in the printer unit PU. If the detector 29 detects a temperature above 35 centigrade, the count of this counter 14*c* increments by one. If this count exceeds twenty-four (24), the value of the purge interval memory 14*b* is changed from five days to three days. This shortens the purge interval. Just after the nozzles are purged, the count of the counter 14*c* is cleared.

The low temperature counter 14*d* stores the frequency of detection of abnormal temperature below 10 centigrade. If a temperature below 10 centigrade is detected in the purge interval change process (FIG. 4), the count of this counter 14*d* increments by one. If this count exceeds twenty-four (24), the value of the purge interval memory 14*b* is changed from five days to three days. This shortens the purge interval. Just after the nozzles are purged, the count of the counter 14*d* is cleared as zero (0).

The NCU 15 is connected through a telephone line 52 to another fax machine 51. The NCU 15 can send a dial signal to the line 52, and respond to a call signal from this line.

The modem 16 can modulate and demodulate image data. The modulated data is transmitted through the NCU 15 to the fax machine 51. The modem 16 can transmit and receive procedural signals for transmission control.

The scanner 19 scans an original fed from the original inlet 4 into the equipment 1. The encoder 17 encodes the image data from the scanner 19 etc. to compress them. The decoder 18 decodes the facsimile data received by the equipment 1 and other coded data. The original sensor 8 determines if an original is placed in the original inlet 4.

The timer 28 clocks the present time, and includes a battery 28*a* to keep clocking the time even after the power switch of the equipment 1 is turned off. The timer 28 can be initialized through the control panel 3. While the equipment 1 is standing by, the present time clocked by the timer 28 is output to the LCD 6, which then functions as a clock display. Just after the nozzles are purged, the present time is read out from the timer 28 by the printer unit PU, and written in the purge time memory 14*a*.

The temperature detector 29 detects the temperature around the print heads. As stated already, the thermister 29*a* of the detector 29 converts the temperature into a value of electric resistance. On the basis of this value, the detector 29 outputs the temperature as digital data.

The printer unit PU includes a CPU 21, a ROM 22, a RAM 23, an interface 24 for a personal computer, a character generator 25 and the printer 26. These components are interconnected through a printer control circuit 27.

The ROM 22 stores the program of the purge interval change process (FIG. 4) and the program of a purge process (FIG. 5), which can be carried out in the printer unit PU. The ROM 22 also stores the control programs to be executed by the CPU 21. The RAM 23 includes work memories, which can be referred to and updated when the CPU 21 executes programs. The RAM 23 also includes a print memory for storing print data.

The interface 24 for a personal computer may be a Centronics (parallel) interface. The interface 24 is connected through a cable 54 to a personal computer 53 as the central unit of the recovery apparatus. The equipment 1 can transmit data to and receive data from the computer 53 through the cable 54. The character generator 25 stores print characters and other vector fonts. In the main process of the printer unit PU, the purge interval change process is carried out regularly once an hour. This changing process can change the value of the purge interval memory 14*b*, depending on the temperature around the print heads.

Figure 4:
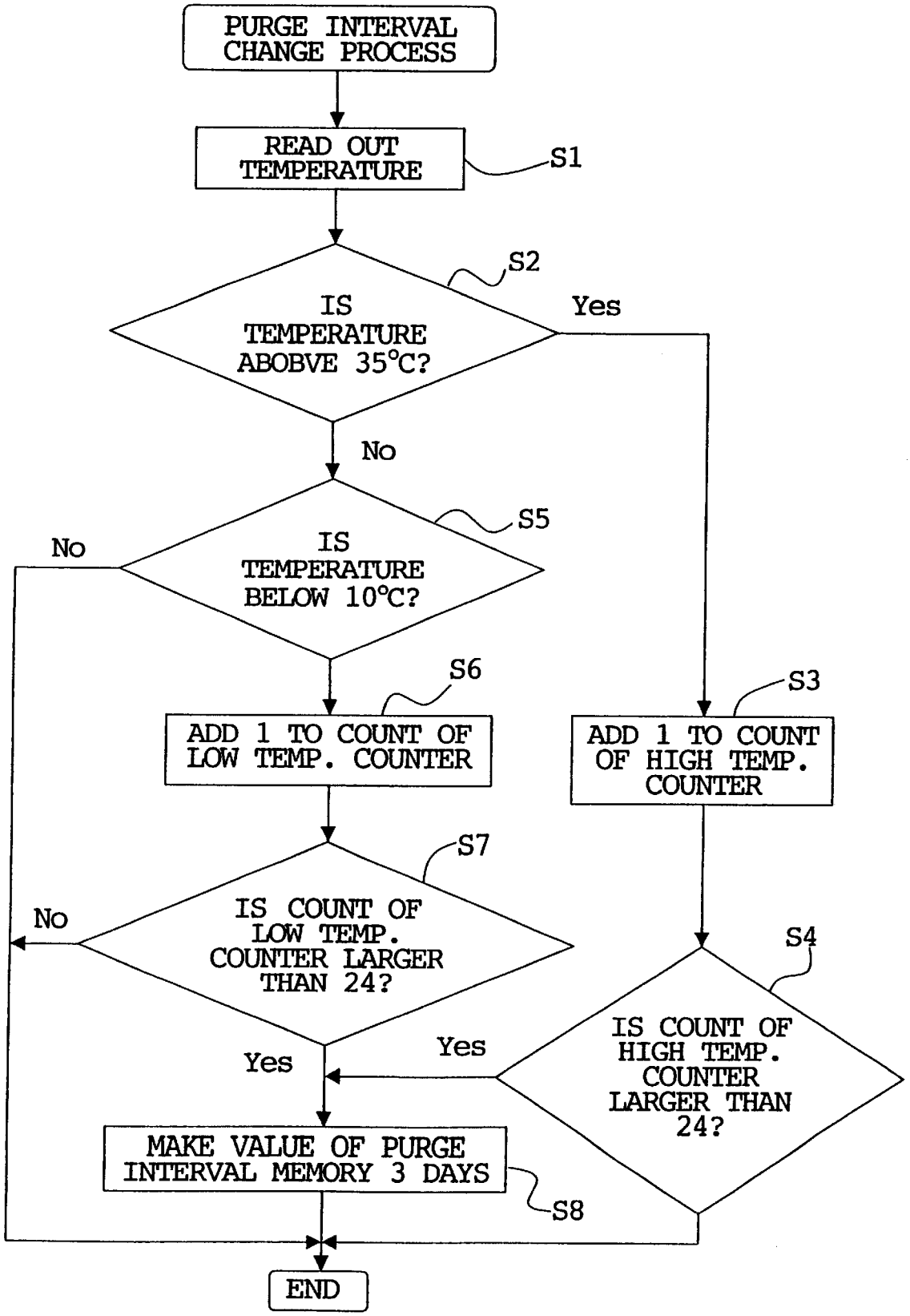
FIG. 4 is a flow chart of the purge interval change process executed in the printer unit of this equipment.

With reference to FIG. 4, the purge interval change process includes reading out the temperature measured by the temperature detector 29 (S1). This reading step is carried out when the power switch of the equipment 1 is turned on, or when one hour has passed after the preceding interval changing process.

If this temperature is above 35 centigrade (S2: yes), the count of the high temperature counter 14*c* increments by one (S3).

If the count of the high temperature counter 14*c* exceeds twenty-four (24) (S4: yes), it may be considered that the temperature was above 35 centigrade substantially for at least 24 hours. Then, the value of the purge interval memory 14*b* is changed from the initial value of five days to three days (S8). This makes the purge interval shorter than normal by two days. Then, the process ends.

If the count of the high temperature counter 14*c* is 24 or less (S4: no), the process ends without changing the value of the purge interval memory 14*b*. In this case, the purge interval is not changed to avoid too frequent purges, because it is considered that temporary abnormality of temperature does not affect the ejection of ink substantially.

If the temperature is below 10 centigrade (S2: no, S5: yes), the count of the low temperature counter 14*d* increments by one (S6). If the count of the low temperature counter 14*d* exceeds 24 (S7: yes), it may be considered that the temperature was below 10 centigrade substantially for at least 24 hours. Then, the value of the purge interval memory 14*b* is changed from the initial value of five days to three days (S8). Then, the process ends. If the count of the low temperature counter 14*d* is 24 or less (S7: no), the process ends without changing the value of the purge interval memory 14*b*.

If the temperature ranges between 10 and 35 centigrade (S2: no, S5: no), it is normal. Then, the process ends without changing the value of the purge interval memory 14*b* and the counts of the counters 14*c* and 14*d*.

The purge process is carried out in the printer unit PU before a printing process is carried out. The printing process is carried out when the equipment 1 prints data received by fax, data input from the computer 53, or the like.

Figure 5:
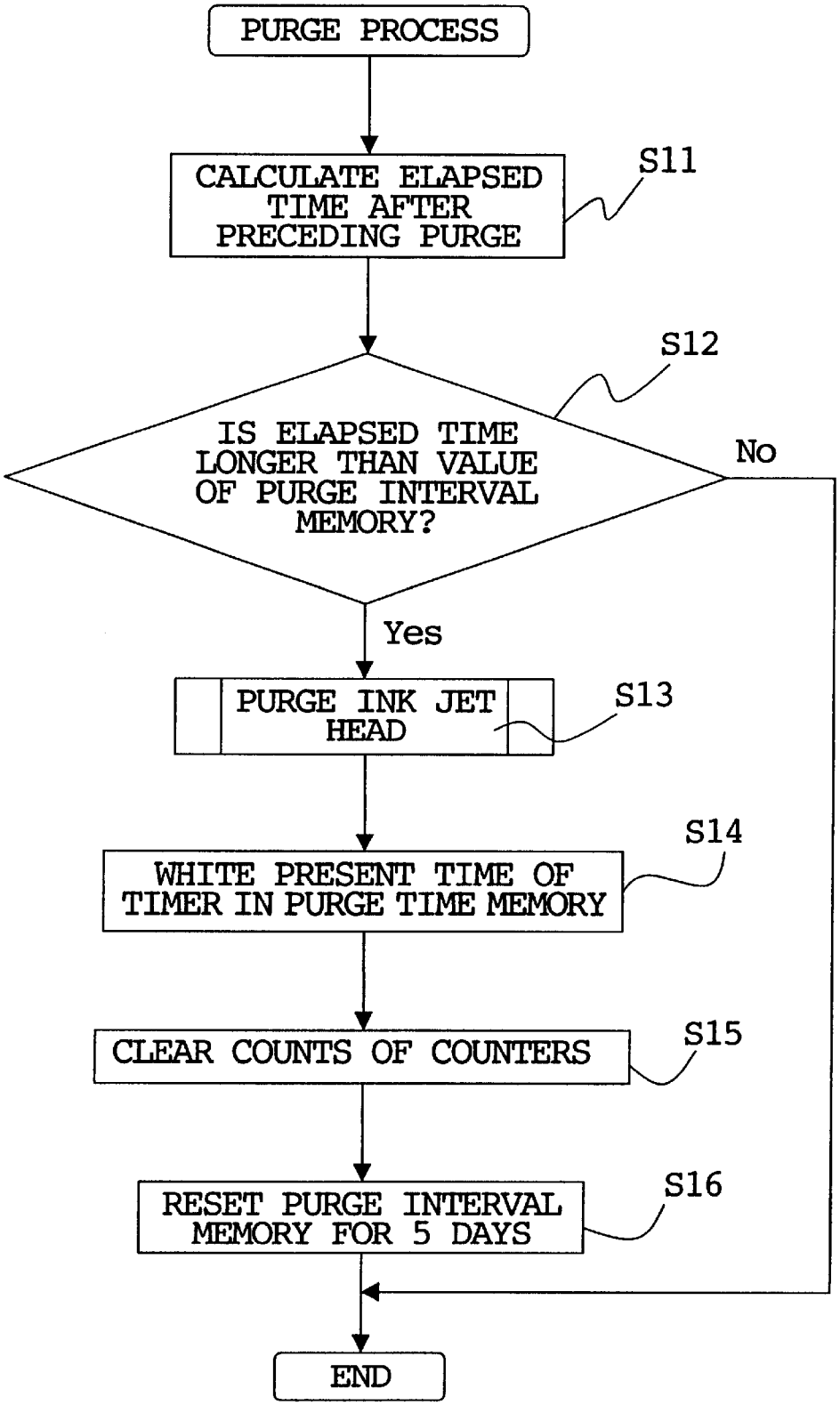
FIG. 5 is a flow chart of the purge process executed in this printer unit.

With reference to FIG. 5, the purge process includes calculating the elapsed time which has passed after the preceding purge (S11). The elapsed time is calculated from the present time read out from the timer 28 and the time read out from the purge time memory 14*a*. As already stated, this memory 14*a* stores the time at which the preceding purge was carried out. The calculated time is compared with the value of the purge interval memory 14*b*, (S12).

As a result of the comparison, if the elapsed time is equal to or shorter than the time stored in the purge interval memory 14*b* (S12: no), it is judged that ink can be ejected normally. Then, the purge process ends without purging the print heads. After this process ends, the printing process is carried out. Because ink can be ejected in good condition, no defective print occurs.

If the elapsed time is longer than the time stored in the purge interval memory 14*b* (S12: yes), ink may be ejected defectively. Then, the recovery mechanism 71 is operated to purge the nozzles (S13).

After the nozzles are purged, the present time is read out from the timer 28 and written in the purge time memory 14*a* (S14). Next, the counts of the counters 14*c* and 14*d* are cleared (S15). Further, the purge interval memory 14*b* is reset for the initial value of five days (S16). Thereafter, the purge process end.

After this process ends, the printing process is carried out. Because the purge process has restored the ejection of ink to normal, no defective print occurs.

As stated above, the purge interval is changed suitably depending on the temperature around the print heads. It is therefore possible to purge the nozzles at a suitable time. This prevents the nozzles from being purged at too long interval, which may cause defective print. This also prevents the nozzles from being purged at too short interval, which accelerates the consumption of ink.

As also stated, the suction cap 72 (FIG. 2) can close all the nozzles of the print heads at a time. It is therefore possible to purge all the nozzles at a time. It is considered that, if a long time has passed after the preceding purge, the nozzles are clogged substantially equally. By purging the nozzles at a time, it is possible to carry out the purge process before the printing process efficiently in a short time.

The invention has been explained hereinbefore with reference to the preferred embodiment, but is not limited to it. Obviously, various improvements and/or modifications may be made without departing from the spirit of the invention.

As stated already, the suction cap 72 can cap the print heads at a time for suction for them all at a time. Otherwise, the heads might be capped individually.

As also stated, the purge time memory 14*a* stores the time at which the preceding purge was carried out, and the purge interval memory 14*b* stores the purge interval. The elapsed time is calculated from the present time clocked by the timer 28 and the time stored in the purge time memory 14*a*. If the elapsed time is longer than the time stored in the purge interval memory 14*b*, the nozzles are purged.

Another purge process embodying the invention includes storing the initial value of five days in the purge interval memory 14*b* after purging the nozzles. In accordance with the timing of the timer 28, the stored value is decreased. When this value is decreased to zero, it is inhibited from decreasing further, and the nozzles are purged. In this case, if the abnormal temperature below 10 centigrade or above 35 centigrade is detected 24 times, two days are subtracted from the value of the purge interval memory 14*b*. If the result of the subtraction is a minus, it is replaced with zero.

What is claimed is:

1. An apparatus for purging an ink jet head having nozzles for ejecting ink, the apparatus comprising:

a cap for covering the nozzles;

a suction pump for sucking ink from the nozzles through the cap covering the nozzles;

a memory storing a regular interval at which the pump should suck ink from the nozzles;

a temperature sensor measuring ambient temperature;

a suction interval change device for changing the stored interval depending on the measured temperature;

a controller for operating the pump at the stored interval; and a counter counting how many times the measured temperature is out of a predetermined range of temperature;

the controller causing the suction pump to suck ink if the temperature has been out of the range more than a predetermined number of times.

2. The apparatus as defined in claim 1, and further comprising a timer for clocking elapsed time after the preceding suction.

3. The apparatus as defined in claim 1, wherein the suction interval change device shortens the stored interval if the measured temperature is out of a predetermined range of temperature.

4. The apparatus as defined in claim 3, wherein the predetermined range is between 10 and 35 centigrade.

5. The apparatus as defined in claim 1, and further comprising a reset device for initializing the stored interval after the suction pump sucks ink.

6. The apparatus as defined in claim 5, wherein the reset device resets the counter after the suction pump sucks ink.

7. The apparatus as defined in claim 1, wherein the temperature sensor is positioned near the ink jet head.

8. The apparatus as defined in claim 1, and further comprising a mover for moving the cap relative to the ink jet head.

9. An ink jet recorder comprising:

an ink jet head having nozzles for ejecting ink;

an apparatus for purging the head, the apparatus including a cap for covering the nozzles and a suction pump for sucking ink from the nozzles through the cap covering the nozzles;

a memory storing a regular interval at which the pump should suck ink from the nozzles;

a temperature sensor measuring ambient temperature;

a suction interval change device for changing the stored interval depending on the measured temperature;

a controller for operating the pump at the stored interval; and a counter periodically counting how many times the measured temperature is out of a predetermined range of temperature;

the controller causing the suction pump to suck ink if the temperature has been out of the range more than a predetermined number of times.

10. The recorder as defined in claim 9, wherein the suction interval change device shortens the stored interval if the measured temperature is out of a predetermined range of temperature.

11. The recorder as defined in claim 10, wherein the apparatus sucks ink provided that a signal for recording is input to the recorder.

12. The recorder as defined in claim 11, and further comprising a timer for clocking the elapsed time after the preceding suction;

the controller comparing the time clocked by the timer with the stored interval when a signal for recording is input to the recorder, the controller causing the suction pump to suck ink if the clocked time is longer than the stored interval.

13. The recorder as defined in claim 12, wherein the initial value of the stored interval is five days.

14. The recorder as defined in claim 9, and further comprising a reset device for initializing the stored interval after the suction pump sucks ink.

15. The recorder as defined in claim 14, wherein the reset device resets the counter after the suction pump sucks ink.

16. The recorder as defined in claim 9, wherein the temperature sensor is positioned near the ink jet head.

17. The recorder as defined in claim 9, wherein the controller also functions as the suction interval change device.

18. The recorder as defined in claim 9, and functioning for at least one of fax transmission, copying and video printing in addition to printing.

19. The recorder as defined in claim 9, wherein the ink jet head includes heads each for ejecting an ink different color.

20. An apparatus for purging an ink jet head having nozzles for ejecting ink, the apparatus comprising:

a cap for covering the nozzles;

a suction pump for sucking ink from the nozzles through the cap covering the nozzles;

a temperature sensor regularly measuring ambient temperature;

a counter counting how many times the measured temperature is in a predetermined range of temperature; and a controller for operating the pump when a number of times counted by the counter reach a predetermined number.

21. The apparatus as defined in claim 20, and further comprising a timer for clocking an elapsed time after the preceding suction.

22. The apparatus as defined in claim 20, and further comprising a reset device for initializing the number of time of the counter after the suction pump sucks ink.

23. The apparatus as defined in claim 20, wherein the counter includes a low temperature counter and a high temperature counter.

* * * * *